US011060387B2

(12) United States Patent
Shen et al.

(10) Patent No.: US 11,060,387 B2
(45) Date of Patent: Jul. 13, 2021

(54) DETERMINING FLUID ALLOCATION IN A WELL WITH A DISTRIBUTED TEMPERATURE SENSING SYSTEM USING DATA FROM A DISTRIBUTED ACOUSTIC SENSING SYSTEM

(71) Applicant: HALLIBURTON ENERGY SERVICES, INC., Houston, TX (US)

(72) Inventors: Yijie Shen, Houston, TX (US); Jason Edward Therrien, Cypress, TX (US); Mikko Jaaskelainen, Katy, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 147 days.

(21) Appl. No.: 16/470,354

(22) PCT Filed: Jan. 18, 2017

(86) PCT No.: PCT/US2017/013917
§ 371 (c)(1),
(2) Date: Jun. 17, 2019

(87) PCT Pub. No.: WO2018/136050
PCT Pub. Date: Jul. 26, 2018

(65) Prior Publication Data
US 2020/0088022 A1 Mar. 19, 2020

(51) Int. Cl.
*E21B 47/14* (2006.01)
*E21B 47/07* (2012.01)
*E21B 43/267* (2006.01)

(52) U.S. Cl.
CPC ..... *E21B 43/267* (2013.01); *E21B 47/07* (2020.05); *E21B 47/14* (2013.01)

(58) Field of Classification Search
CPC ..... E21B 43/267; E21B 47/07; E21B 47/14
See application file for complete search history.

(56) References Cited

U.S. PATENT DOCUMENTS 4,947,682 A * 8/1990 Anderson ..... G01N 25/18 73/152.12
2007/0185655 A1* 8/2007 Le Bemadjiel ..... E21B 43/04 702/6

(Continued)

FOREIGN PATENT DOCUMENTS

WO 2015076976 A1 5/2015
WO 2015167583 A1 11/2015
WO 2016195846 A1 12/2016

OTHER PUBLICATIONS

Kalia, et al., "Wellbore Monitoring in Unconventional Reservoirs: Value of Accurate DTS Interpretation and Risks Involved", Apr. 2014, 14 pages.

(Continued)

*Primary Examiner* — Silvana C Runyan
(74) *Attorney, Agent, or Firm* — Kilpatrick Townsend & Stockton LLP

(57) ABSTRACT

Fluid allocation in a well can be determined with a distributed temperature sensing system using data from a distributed acoustic sensing system. Flow data indicating a flow rate of a fluid through a perforation in a well based on an acoustic signal generated during a hydraulic fracturing operation in the well can be received. Warm-back data indicating an increase in temperature at the perforation can be received. A fluid allocation model can be generated based on the flow data and the warm-back data. The fluid allocation model can represent positions of the fluid in fractures formed in a subterranean formation of the well.

16 Claims, 8 Drawing Sheets

(56) References Cited

U.S. PATENT DOCUMENTS

| | | | | |
|---|---|---|---|---|
| 2007/0215345 | A1* | 9/2007 | Lafferty | E21B 43/26 166/250.1 |
| 2008/0120036 | A1* | 5/2008 | Kimminau | E21B 47/135 702/12 |
| 2011/0288843 | A1 | 11/2011 | Weng et al. | |
| 2012/0016587 | A1 | 1/2012 | Sierra et al. | |
| 2015/0096942 | A1 | 4/2015 | Wang et al. | |
| 2016/0273346 | A1* | 9/2016 | Tang | E21B 47/06 |
| 2018/0149015 | A1* | 5/2018 | Duan | E21B 47/07 |

OTHER PUBLICATIONS

PCT/US2017/013917, "International Search Report and Written Opinion", dated Oct. 17, 2017, 17 pages.

Stokely, "Acoustics-Based Flow Monitoring During Hydraulic Fracturing", Feb. 2016, 24 pages.

Survey (article-category-4.html): LinkQuest Releases FlowQuest Acoustic Current Profilers (Aug. 9, 2016)—ROVworld Subsea Information, www.rovworld.com/article960.html, Aug. 9, 2006, 5 pages.

FiberView Software Providies Real-Time Fiber-Optic Data Viewing and Analysis for Completion, Wellbore, and Reservoir Evaluation, H012212, May 2016, 2 pages.

* cited by examiner

DETERMINING FLUID ALLOCATION IN A WELL WITH A DISTRIBUTED TEMPERATURE SENSING SYSTEM USING DATA FROM A DISTRIBUTED ACOUSTIC SENSING SYSTEM

TECHNICAL FIELD

The present disclosure relates generally to hydraulic fracturing in a wellbore, and more particularly (although not necessarily exclusively), to determining fluid allocation in a well with a distributed temperature sensing system using data from a distributed acoustic sensing system.

BACKGROUND

Fracking can be performed in a well system, such as an oil or gas well for extracting hydrocarbon fluids from a subterranean formation to increase a flow of the hydrocarbon fluids from the subterranean formation. Hydraulic fracturing can include pumping a treatment fluid that includes a proppant mixture into a wellbore formed through the subterranean formation. The treatment fluid can create perforations in the subterranean formation and the proppant mixture can fill the perforations to prop the perforations open. Propping the perforations open can allow the hydrocarbon fluids to flow from the subterranean formation through the perforations and into the wellbore. In some examples, the wellbore is divided into stages such that each stage includes one or more perforation clusters and each perforation cluster includes one or more perforations. A hydraulic fracturing process can be intended to create uniform perforations within each stage. A screen-out can occur when a first perforation fills with proppant before a second perforation in a stage, preventing the treatment fluid from enlarging the first perforation. Screen-outs can result in non-uniform perforations, which can reduce the effectiveness of the hydraulic fracturing process. Once a screen-out is detected and located, different treatment fluids can be pumped into the wellbore at different rates to overcome the screen-out and create more uniform fractures.

DETAILED DESCRIPTION

Figure 1:
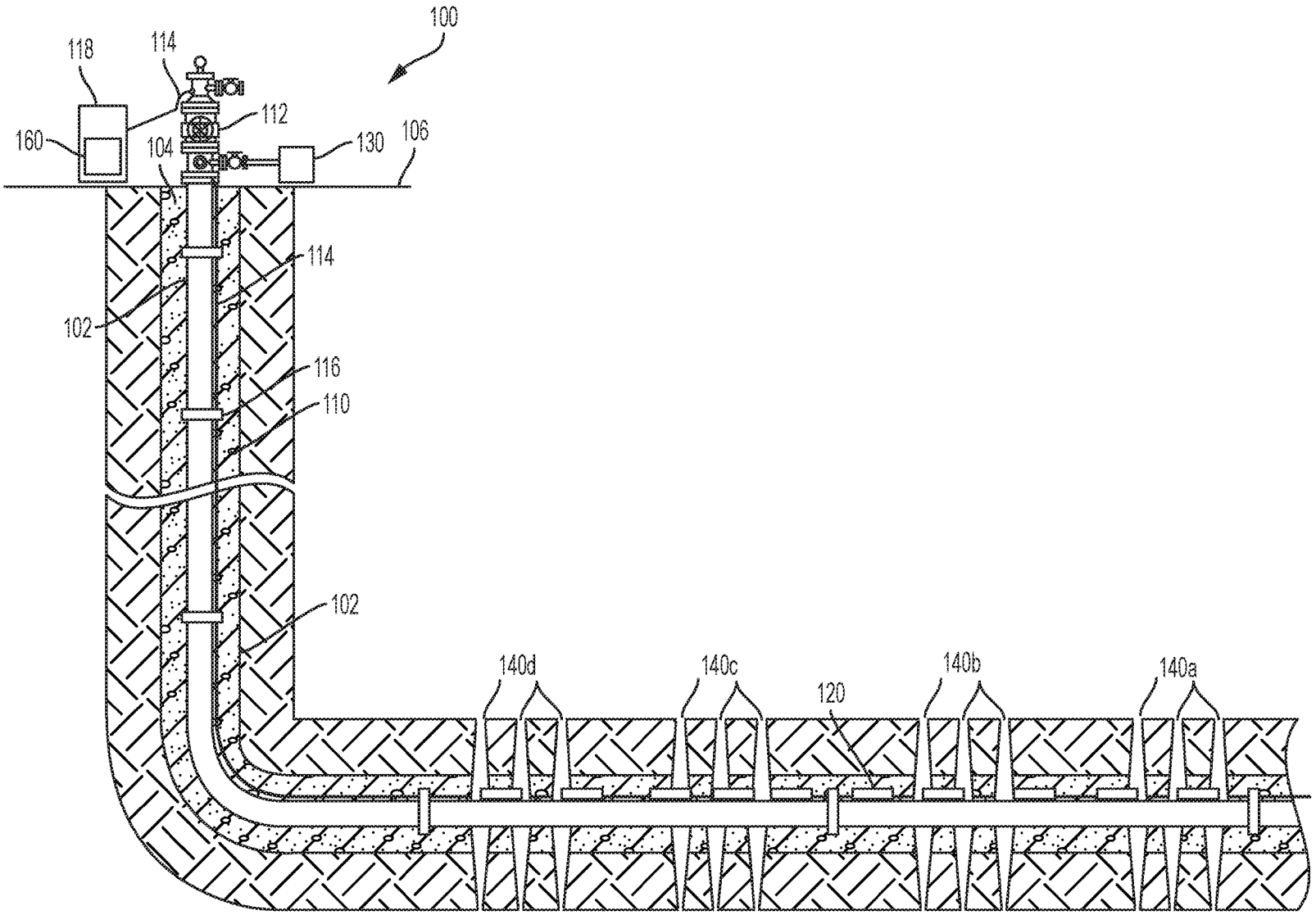
FIG. 1 is a diagram of an example of a well system including a processing device for determining fluid allocation in a well according to one aspect of the present disclosure.

Certain aspects and features relate to determining fluid allocation in a well with a distributed temperature sensing system ("DTS") using data from a distributed acoustic sensing system ("DAS"). A hydraulic fracturing process can include pumping a treatment fluid into a wellbore at a known rate to create and enlarge perforations. A DAS can measure data about acoustic signals generated by the treatment fluid moving through the perforations. A processing device can identify a screen-out in real time, or at substantially the same time that the screen-out forms, at a perforation based on the data. A DTS can measure warm-back data (e.g., data indicating an increase in temperature toward a geothermal temperature) based on the temperature at the perforation as the perforation warms in response to the screen-out identified by the DAS data. Another (or the same) processing device can generate a flow allocation model of the treatment fluid based on the warm-back data. Using quantitative DAS results can provide a more accurate input to a DTS quantitative flow model, which can improve the accuracy of fluid allocation modeling and analysis of the hydraulic fracturing process. A fluid allocation model can represent a calculation of positions of the treatment fluid in the well, which can be used to determine characteristics (e.g., a size, a shape, and a location) of fractures formed during the hydraulic fracturing process.

In some aspects, a DAS may include an interrogation device positioned at a surface proximate to a wellbore and coupled to an optical fiber extending from the surface into the wellbore. An optical source of the interrogation device may transmit an optical signal, or an interrogation signal, downhole into the wellbore through the optical fiber. Backscattering of the optical signal can occur based on the optical signal interacting with the optical fiber and can cause the optical signal to propagate back toward an optical receiver in the interrogation device. In some examples, different backscattering can occur based on acoustic signals causing a vibration in the optical fiber or thermal signals (e.g., changes in temperature) causing thermal expansion of the cable and movement or expansion of the optical fiber. The acoustic signals and the thermal signals may have different frequency content. The optical signal can be analyzed to determine real-time data about the acoustic signals including an intensity and location of the acoustic signal or changes in temperature. A DAS can detect signals anywhere along a length of optical fiber in substantially real time (e.g., real time can be limited by the travel time of the optical pulse from the DAS signal transmitter to the end of the optical fiber and back to the DAS optical receiver). For example, the DAS can measure real-time data about acoustic signals produced by treatment fluid flowing through perforations in the subterranean formation during a hydraulic fracturing process. The real-time data can be used to determine expected flow rates at each perforation cluster in a wellbore, which can allow for screen-outs to be detected in real-time (e.g., detected substantially contemporaneously as the screen-outs occur).

Screen-outs can have a negative impact on well productivity and reduce the effectiveness of the hydraulic fracturing process. In some examples, a screen-out can be an operational risk by causing a pressure of treatment fluid at a surface of the wellbore to exceed the safety limitations, which can result in a premature termination of the hydraulic fracturing process. Terminating the stimulation treatment prematurely can result in expensive cleanout runs with coiled tubing and a substantial amount of non-productive time. Accurately predicting when and where a screen-out will occur can be difficult because screen-outs can be caused by various downhole conditions.

In some aspects, DTS can include an interrogation device positioned at a surface proximate to a wellbore and coupled to an optical fiber extending from the surface into the wellbore. The interrogation device and optical fiber can be part of the DAS as well. But, backscattered optical signals can be analyzed by the DTS to determine real-time data about temperatures at different locations in the wellbore. Real time data with a DTS system can be limited by the travel time of the optical pulses and the data can be averaged on a time scale of a few seconds to a few tens of seconds to improve temperature resolution. While treatment fluid flows through a perforation, the temperature at a perforation may decrease. Once the treatment fluid stops flowing through the perforation (e.g., due to a screen-out or due to treatment fluid no longer being injected into the well) the perforation can begin to warm back towards the geothermal gradient. DTS data during warm back can provide quantitative fluid allocation across perforation clusters. For example, fractures that take large volumes of fluid can take longer to return to a geothermal temperature and fractures that take smaller volumes of fluids show more immediate warm back. Determining fluid allocation with a DTS can include calculating the size, shape, and location of fractures formed during the hydraulic fracturing process based on the change in temperature at each perforation, the amount of the time that elapses during warm back, and a thermal conductivity of a reservoir associated with the perforation.

In some existing systems, fluid allocation is determined with DTS using one or more assumptions. In some examples, a warm back start time can be assumed by existing systems as the same across perforation zones. But, warm back can begin at each perforation at a different time. Perforations with a screen-out can begin to warm while other perforations continue to cool as treatment fluid passes therethrough. The data from a DAS can provide real-time identification of screen-outs at specific perforations and a DTS can more accurately determine the start time of a warm back. Filtered DAS data at different frequency bands can be used for different purposes. For example, the lower frequency components of DAS data may be more closely related to thermal effects and the higher frequency components may be more closely related to acoustic signals.

In additional or alternative examples, a thermal conductivity or heat transfer rate in a reservoir can be assumed by existing systems as constant across space and time. But, thermal conductivity of reservoirs can vary spatially across the reservoir space as treatment fluid enters the reservoir through the perforation. Initially, a reservoir can be a porous media that includes a solid portion made of rock and an opening having formation fluid (e.g., oil or gas) therein. As treatment fluid enters into reservoir through perforation clusters, fractures in the solid portion can be created and may fill with treatment fluid. The fractures can become longer and wider as more treatment fluid enters into the reservoir. At different perforation clusters, the amount of treatment fluid entering the reservoir can be different and can create different geometries of fractures. The greater the amount of treatment fluid entering a reservoir, the more reservoir thermal conductivity may be dominated by treatment fluid. The data from a DAS can be used to determine a thermal conductivity for a perforation such that the DTS can provide more accurate results. For example, data from the DAS can be used to calculate the amount of treatment fluid having passed through the perforation and a proppant distribution across perforations based on the acoustic data.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure.

FIG. 1 illustrates an example of a well system 100 that may include a distributed acoustic sensing system according to some aspects of the present disclosure. The well system 100 includes a casing string 102 positioned in a wellbore 104 that has been formed in a surface 106 of the earth. The well system 100 may have been constructed and completed in any suitable manner, such as by use of a drilling assembly having a drill bit for creating the wellbore 104. The casing string 102 may include tubular casing sections connected by end-to-end couplings. In some aspects, the casing string 102 may be made of a suitable material such as steel. Within the wellbore 104, cement 110 may be injected and allowed to set between an outer surface of the casing string 102 and an inner surface of the wellbore 104.

At the surface 106 of the wellbore 104, a tree assembly 112 may be joined to the casing string 102. The tree assembly 112 may include an assembly of valves, spools, fittings, etc. to direct and control the flow of fluid (e.g., oil, gas, water, etc.) into or out of the wellbore 104 within the casing string 102. For example, a pump 130 can be coupled to the tree assembly 112 for injecting a treatment fluid into the wellbore 104 as part of a hydraulic fracturing process. The treatment fluid can form the perforation clusters 140*a-d* through the outer surface of the casing string 102, the cement, and a surrounding subterranean formation. Each perforation cluster 140*a-d* can include one or more fractures and the treatment fluid can include proppant for propping the fractures open such that production fluid can flow from the surrounding subterranean formation into the wellbore 104.

Optical fibers 114 may be routed through one or more ports in the tree assembly 112 and extend along an outer surface of the casing string 102. The optical fibers 114 can include multiple optical fibers. For example, the optical fibers 114 can include one or more single-mode optical fibers or one or more multimode optical fibers. Each of the optical fibers 114 may include one or more optical sensors 120 along the optical fibers 114. The sensors 120 may be deployed in the wellbore 104 and used to sense and transmit measurements of downhole conditions in the well system 100 to the surface 106. In some examples, the sensors 120 may measure an acoustic signal generated as the treatment fluid from the pump 130 passes through one of the perforation clusters 140*a-d*. In additional or alternative examples, the sensors 120 may measure a temperature at one of the perforation clusters 140*a*. The optical fibers 114 may be retained against the outer surface of the casing string 102 at intervals by coupling bands 116 that extend around the casing string 102. The optical fibers 114 may be retained by at least two of the coupling bands 116. In some aspects, the optical fibers 114 can be positioned exterior to the casing string 102, but other deployment options may also be implemented. For example, the optical fibers 114 can be coupled to a wireline or coiled tubing that can be positioned in an inner area of the casing string 102. The optical fibers 114 can be coupled to the wireline or coiled tubing such that the optical fibers 114 are removable with the wireline or coiled tubing.

The optical fibers 114 can be coupled to an interrogation subsystem 118. The interrogation subsystem 118 can be part of a DAS, a DTS, or a combination thereof. The interrogation subsystem 118 is positioned at the surface 106 of the wellbore 104. In some aspects, the interrogation subsystem 118 may be an opto-electronic unit that may include devices and components to interrogate the sensors 120 coupled to the optical fibers 114. For example, the interrogation subsystem 118 may include an optical source, such as a laser device, that can generate optical signals to be transmitted through one or more of the optical fibers 114 to the sensors 120 in the wellbore 104. The interrogation subsystem 118 may also include an optical receiver to receive and perform interferometric measurements of backscattered optical signals from the sensors 120 coupled to the optical fibers 114

Although FIG. 1 depicts the optical fibers 114 as being coupled to the sensors 120, the optical fibers 114 can form a sensing optical fiber and operate as a sensor. A sensing optical fiber can be remotely interrogated by transmitting an optical signal downhole through the optical fibers 114. In some examples, Rayleigh scattering from random variations of a refractive index in the optical waveguide can produce backscattered light. By measuring a difference in an optical phase of the scattering occurring at two locations along the optical fibers 114 and tracking changes in the phase difference over time, a virtual vibration sensor can be formed in the region between the two scattering location. By sampling the backscattered optical signals at a high rate (e.g., 100 MHz) the optical fibers 114 can be partitioned into an array of vibration sensors.

In this example, the interrogation subsystem 118 includes a processing device 160 for determining fluid allocation in the subterranean formation. In additional or alternative examples, a processing device can be separate from, but communicatively coupled to, the interrogation subsystem 118. For example, a processing device can be included in the pump 130. Some of the sensors 120 can measure acoustic signals generated by the treatment fluid passing through the perforation clusters 140*a-d* and provide optical signals based on the acoustic signals to the interrogation subsystem 118. The processing device 160 can use the optical signals to determine an expected flow rate of the treatment fluid through each of the perforation clusters 140*a-d*. The processing device 160 can determine that a screen-out is occurring at a perforation cluster 140*a* based on a change in a slope of the expected flow rate of the treatment fluid through the perforation cluster 140*a*. Some of the sensors 120 can measure a temperature at the perforation cluster 140*a* and provide optical signals based on the temperature to the interrogation subsystem 118. The processing device can determine a flow allocation model based on the flow rate prior to the screen-out and the temperature of the perforation after the screen-out.

In some aspects, the sensing system 100 may also include one or more electrical sensors deployed using an electrical cable deployed similarly to the optical cable 114. In additional or alternative aspects, the cable 114 can be a hybrid opto-electrical cable housing both optical fibers and electrical conductors for electrical sensors.

Figure 2:
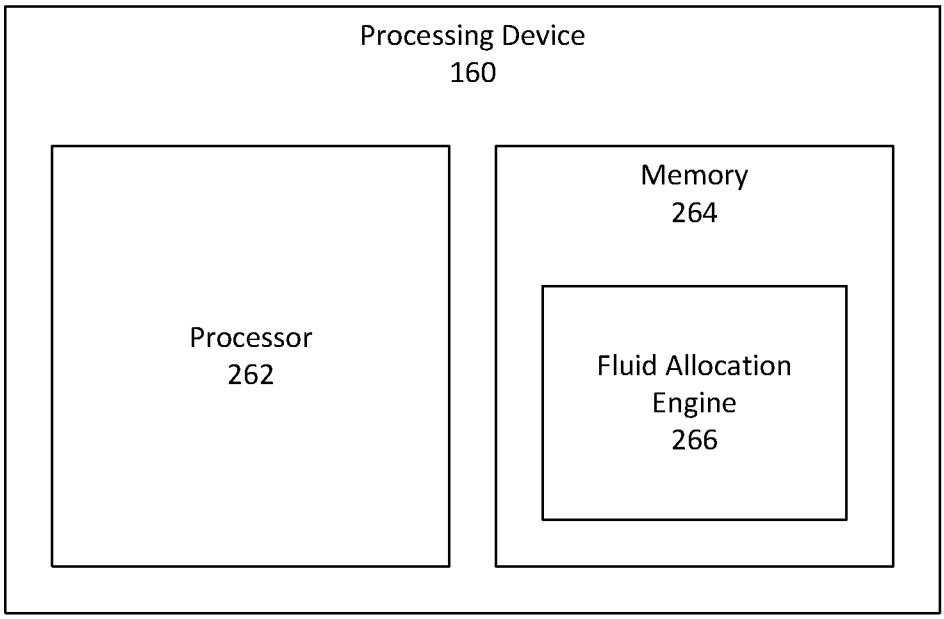
FIG. 2 is a block diagram of a processing device for determining a fluid allocation in a well according to one aspect of the present disclosure.

FIG. 2 depicts an example of the processing device 160 in FIG. 1. The processing device 160 can include any number of processors 262 configured for executing program code stored in memory 264. Examples of the processing device 160 can include a microprocessor, an application-specific integrated circuit ("ASIC"), a field-programmable gate array ("FPGA"), or other suitable processor. In some aspects, the processing device 160 can be a dedicated processing device used for determining fluid allocation in a well with a DTS using data from a DAS. In additional or alternative aspects, the processing device 160 can perform functions in addition to determining the flow allocation model. In some examples, the processing device 160 can be communicatively coupled to (or included in) a DAS for determining a flow rate of treatment fluid through a perforation based on an acoustic signal. In additional or alternative examples, the processing device 160 can determine a pumping schedule for a hydraulic fracturing process and communicate with a pump to perform the operation.

The processing device 160 can include (or be communicatively coupled with) a non-transitory computer-readable memory 264. The memory 264 can include one or more memory device that can store program instructions. The program instructions can include for example, a fluid allocation engine 266 that is executable by the processing device 160 to perform certain operations described herein.

The operations can include determining a flow allocation in a well with a DTS using data from a DAS. For example, the instructions can be executed by the processing device 160 for causing the processing device 160 to receive flow data indicating a screen-out is occurring at a perforation in a well based on an acoustic signal generated in the well during a hydraulic fracturing operation. The instructions can further cause the processing device 160 to receive warm-back data indicating an increase in temperature at the perforation in response to the screen-out. The instructions can also cause the processing device 160 to generate a fluid allocation model based on the warm-back data.

The operations can further include detecting and locating a screen-out in real time based on an acoustic signal. For example, the instructions can be executed by the processing device 160 for causing the processing device 160 to receive data based on an acoustic signal generated in the wellbore 104 during a hydraulic fracturing operation. The acoustic signal can have been generated by treatment fluid flowing through a specific perforation, or perforation cluster 140*a*, in a subterranean formation. The instructions can further cause the processing device 160 to determine flow rates of the treatment fluid through the perforation based on the data. The instructions can further cause the processing device to determine that a screen-out occurred at the perforation based on a change in the slope of the flow rates of the fluid through the perforation. The change in the slope can be a change from a positive slope to a negative slope and the difference in the magnitude of the positive slope and the negative slope can exceed a threshold value.

The operations can further include calibrating the threshold value such that the processing device accurately detects screen-outs. For example, the instructions can be executable by the processing device for causing the processing device to detect one or more additional screen-outs at a perforation using a DTS. The instructions can further cause the processing device to determine the threshold value based on a change in slope of the flow rate at the perforation during the one or more additional screen-outs.

Figure 3:
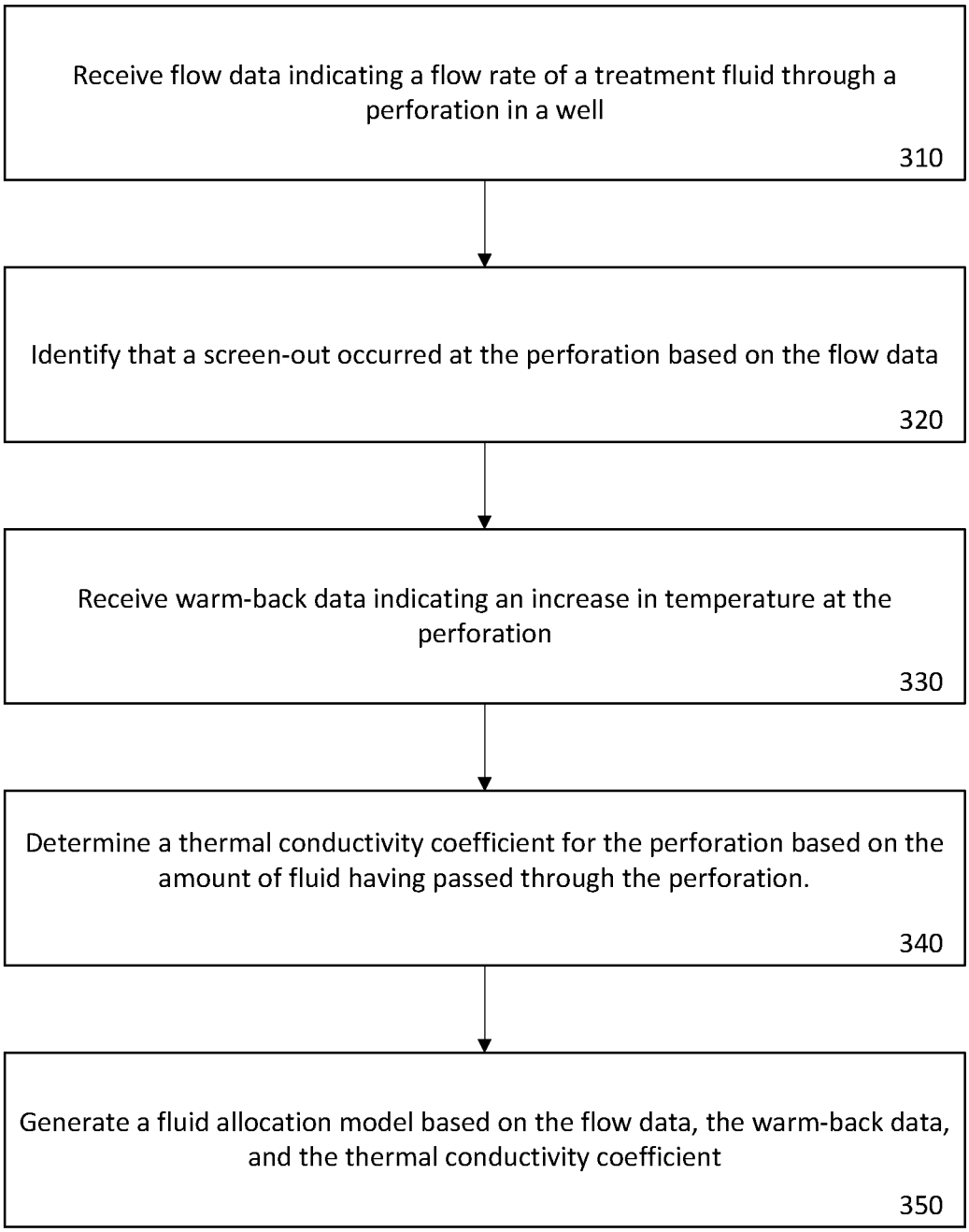
FIG. 3 is a flowchart of a process for determining a fluid allocation in a well according to one aspect of the present disclosure.

FIG. 3 depicts a process for determining fluid allocation in a well with a DTS using data from a DAS. The process as described below is performed by the processing device 160 in FIGS. 1-2, but other implementations are possible.

In block 310, data based on acoustic signals generated in the wellbore 104 by treatment fluid moving through perforation clusters 140*a-d* is received at the processing device 160. In some examples, the processing device can receive the data from the interrogation subsystem 118 of the DAS. The DAS can transmit optical signals along the optical fiber 114 to interrogate sensors 120, which measure data about the acoustic signals. The data can include acoustic intensity measurements.

Figure 4:
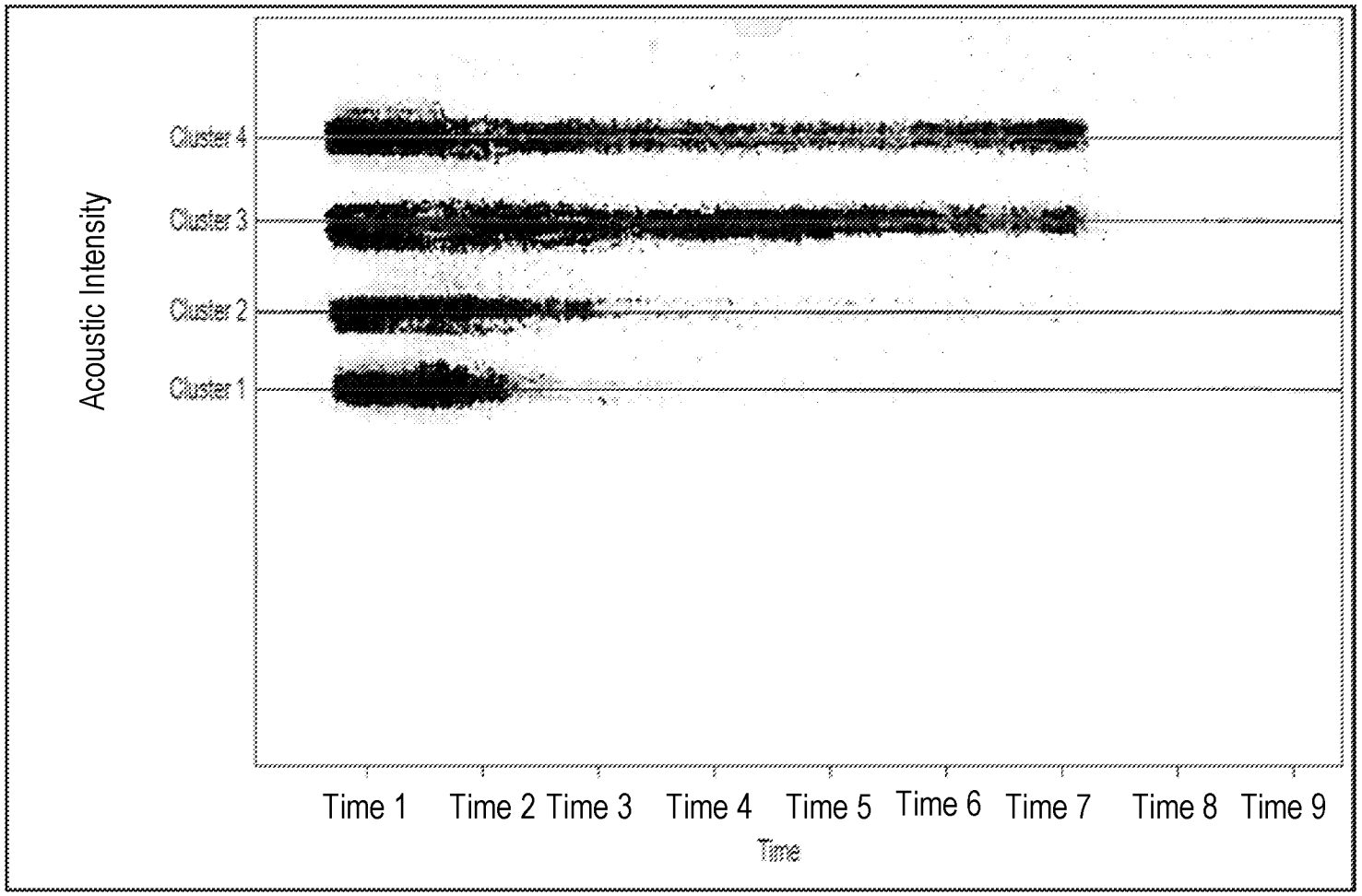
FIG. 4 is a diagram of an example of acoustic intensity data for perforation clusters in a well system during a hydraulic fracturing process according to one aspect of the present disclosure.

FIG. 4 illustrates an example of acoustic intensity data measured by a DAS for a stage with four different perforation clusters (Cluster 1, Cluster 2, Cluster 3, and Cluster 4) during a hydraulic fracturing process. The acoustic intensity data is highest for the perforation clusters at the beginning of the hydraulic fracturing process as fluid enters reservoir locations through each of the perforation clusters. As the proppant starts to be positioned into the perforations the value of the acoustic intensity data can be reduced due, for example, to erosion of a perforation opening. The value of the acoustic intensity data can be reduced to zero as a screen-out prevents treatment fluid from passing through the perforation or as treatment fluid stops being injected into the wellbore 104. Although FIG. 4 illustrates acoustic intensity data for an entire hydraulic fracturing process, the processing device 160 can receive real-time acoustic intensity information for each of the perforation clusters.

In block 320 of FIG. 3, the processing device 160 identifies that a screen-out occurred at the perforation based on the flow data. In some aspects, the processing device 160 determines that a screen-out occurred at a perforation cluster 140*a* based on a change in a slope of the of the flow rate through the perforation. The processing device 160 can use the acoustic intensity data about an acoustic signal generated by the treatment fluid passing through the perforation clusters 140*a-d* to determine the flow rate of the treatment fluid through each of the perforation clusters 140*a-d*. In some examples, the processing device 160 stores a previous acoustic intensity value and an associated previous flow rate in a database or in the memory 164. The processing device can determine the expected flow rate by adjusting the previous flow rate based on a difference between the previous acoustic intensity value and a current acoustic intensity value. In additional or alternative aspects, the processing device 160 can determine the expected flow rate based on the current acoustic intensity value and characteristics of the perforation cluster (e.g., size of perforation opening).

Figure 5:
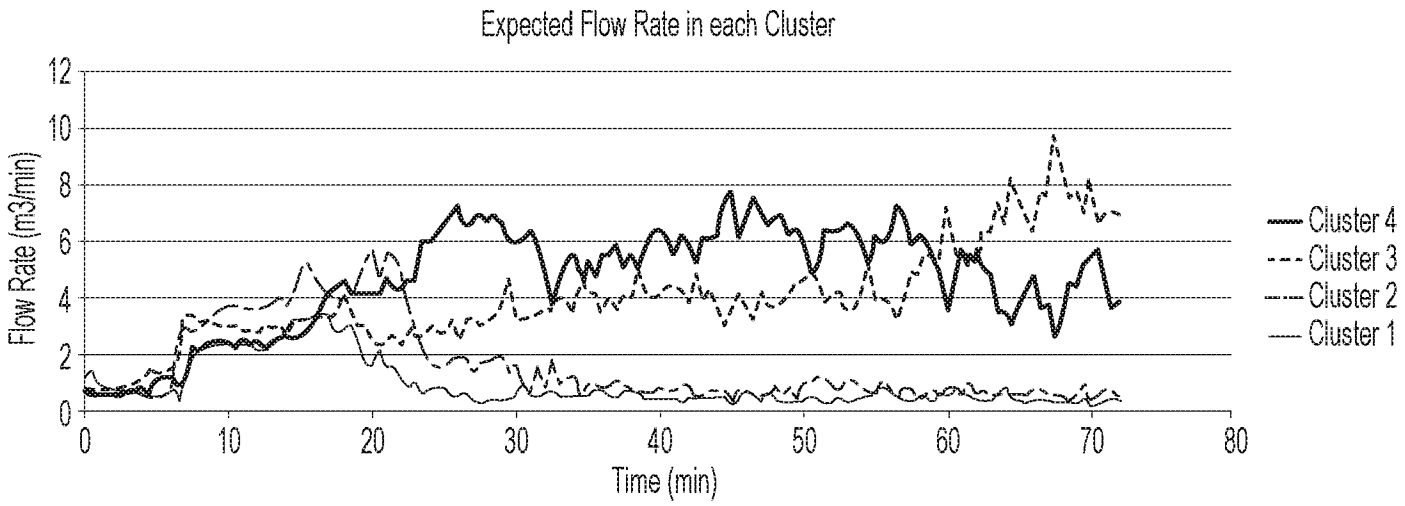
FIG. 5 is a diagram of an example of an expected flow rate for each perforation cluster in a well system according to one aspect of the present disclosure.

FIG. 5 indicates an expected flow rate in Cluster 1, Cluster 2, Cluster 3, and Cluster 4 of FIG. 4. The processing device 160 can determine the expected flow rates in FIG. 6 based on the acoustic intensity data in FIG. 4. For example, as the acoustic intensity for Cluster 1 and Cluster 2 decreases in FIG. 4 (at approximately twenty minutes after the start of the hydraulic fracturing process), the processing device determines the expected flow rate for Cluster 1 and Cluster 2 decreases. Although FIG. 5 illustrates expected flow rates for an entire hydraulic fracturing process, the processing device 160 can determine expected flow rates for each perforation cluster in real-time.

Returning to block 320 of FIG. 3, the processing device 160 can detect a screen-out occurred in the wellbore 104 by comparing an actual total flow rate of the treatment fluid being injected into the wellbore 104 with an expected total flow rate of the treatment fluid being injected into the wellbore 104. In some examples, the processing device 160 can be communicatively coupled to (or included in) the pump 130 for receiving the actual flow rate of the treatment fluid being injected into the wellbore 104. The pump 130 can follow a pumping schedule that indicates a type and amount of treatment fluid to inject into the wellbore 104. The pump 130 can transmit a signal to the processing device 160 including the pumping schedule or the amount of treatment fluid being injected into the wellbore 104. In additional or alternative examples, the processing device 160 can determine the actual total flow rate based on a sensor at or near the surface 106 (e.g., closer to the surface 106 than the perforation clusters 140*a-d*) of the wellbore 104.

In some examples, the expected total flow rate is calculated by the processing device 160 based on a regression between the actual total flow rate and the acoustic intensity data. The processing device 160 can use the actual total flow rate to initially allocate a flow rate to each of the perforation clusters 140*a-d*. The expected flow rate of each perforation cluster, calculated by the processing device 160, can show that perforation clusters 140*a-d* closer to a toe of the wellbore can be given a lower flow allocation than perforation clusters 140*a-d* closer to the heel of the wellbore. The processing device 160 can monitor changes in the acoustic intensity at each of the perforation clusters 140*a-d* and use the changes in the acoustic intensity to determine the expected total flow rate in real time.

In some aspects, the processing device 160 can determine that the screen-out occurred at the perforation cluster based on a change in the slope of the expected flow rates of the treatment fluid through the perforation cluster. In some examples, the slope of an expected flow rate can change from positive to negative as a screen-out occurs and less treatment fluid begins to pass through the perforation cluster. The processing device 160 can store a previous expected flow rate in a database or in the memory 164 and compare a current expected flow rate with the previous flow rate to determine if the change in slope is negative. In additional or alternative examples, the processing device 160 can store more than one previous expected flow rate and compare a change in slope of the flow rate over more than one expected flow rate.

Figure 6:
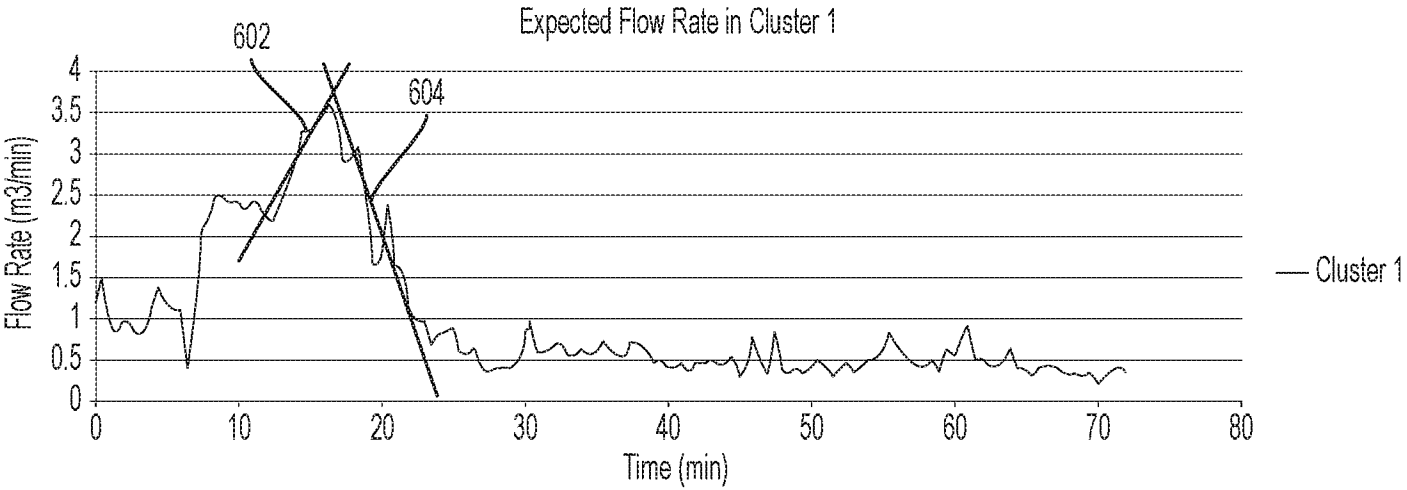
FIG. 6 is a diagram of an example of an expected flow rate for a perforation cluster in a well system according to one aspect of the present disclosure.

FIG. 6 illustrates a positive slope 602 and a negative slope 604 for the expected flow rate of Cluster 1. The positive slope 602 can be the average slope over one or more expected flow rates and the negative slope 604 can be the average slope over one or more subsequent expected flow rates. The processing device 160 can determine that a screen-out occurred based on the change in positive slope 602 and the negative slope 606. In some aspects, the processing device 160 can determine a screen-out has occurred if the change in slope exceeds a threshold value. The threshold value can be set to avoid misidentifying small changes in the slope as screen-outs. In some examples, small changes in the slope of the expected flow rate can be caused by noise. In additional or alternative examples, small changes in the slope of the expected flow rate can be caused by the pump 130 or erosion of an opening of the perforation cluster. In FIG. 6, the magnitude of the negative slope 604 is not equal to the magnitude of the positive slope 602. As the negative slope 604 starts to deviate from the positive slope 602, the perforation cluster can start to screen-out.

In block 330 of FIG. 3, the processing device 160 can receive warm-back data indicating an increase in temperature at the perforation. The processing device 160 can receive warm-back data from a DTS formed by the interrogation subsystem 118 and optical fibers 114. In some examples, the processing device 160 can cause the DTS to measure warm-back data at the perforation in response to determining that a screen-out occurred at the perforation. In additional or alternative examples, the DTS may constantly monitor temperature at the perforation and the processing device 160 may determine the warm-back data based on the monitored temperatures and a time that the screen-out occurred.

Figure 7:
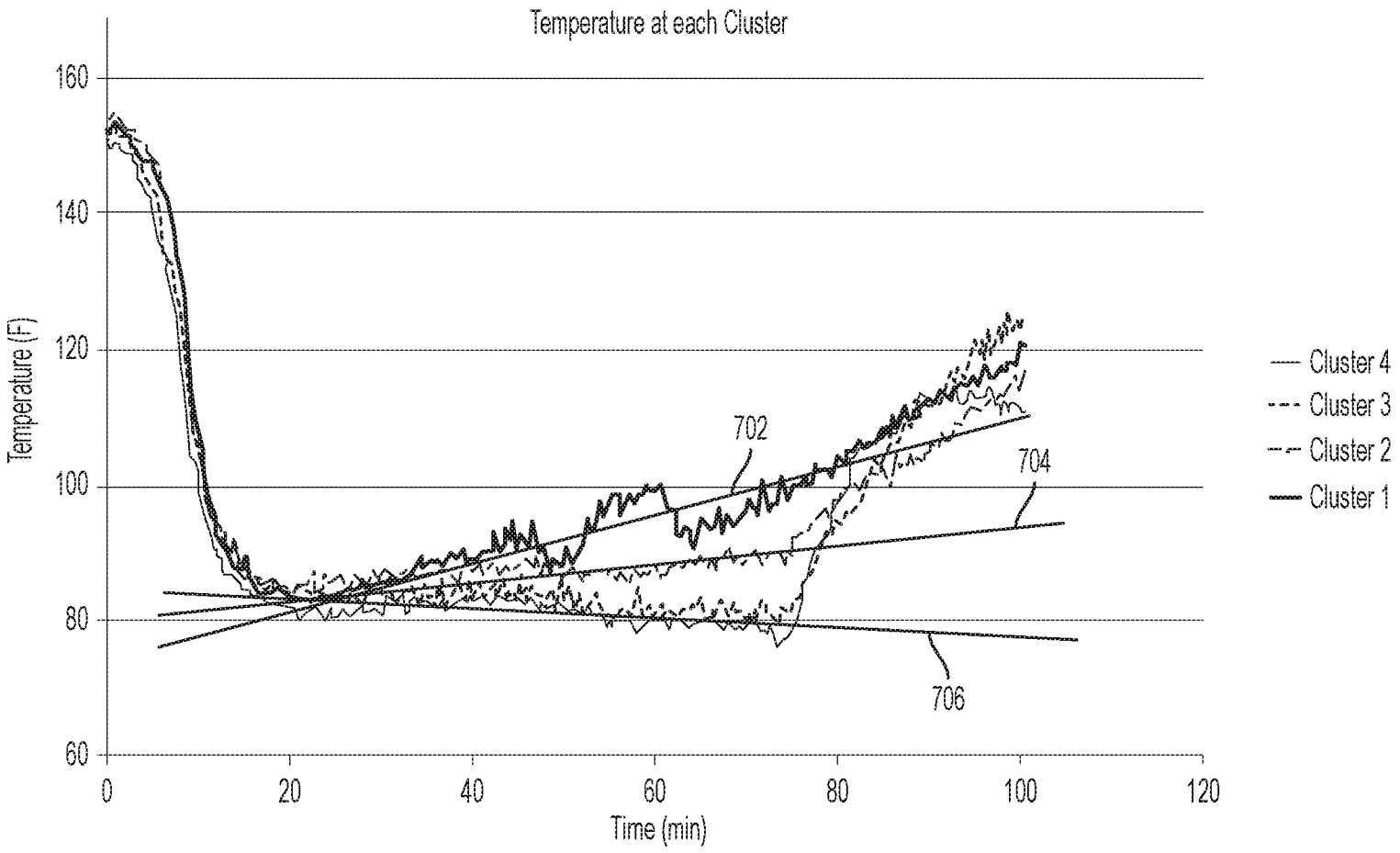
FIG. 7 is a diagram of an example of temperature measurements of each perforation cluster in a well system according to one aspect of the present disclosure.

FIG. 7 illustrates a temperature response at four perforation clusters during a hydraulic fracturing process. Temperatures at each of the perforation clusters initially cool down as treatment fluid passes through each of the perforation clusters. Slope 702, 704 of the temperature response are positive and indicate Cluster 1 and Cluster 2 started to warm back after approximately thirty minutes of fracturing. Slope 706, determined at the same time as slope 702, 704 is negative and indicates that the temperature of Cluster 3 and Cluster 4 are declining at the same time that temperatures in Cluster 1 and Cluster 2 are increasing. The slope 702 is steeper than slope 704 indicating that Cluster 1 has a quicker warm-back than Cluster 2. Cluster 3 and Cluster 4 begin to warm back approximately 70 minutes after the start of the hydraulic fracturing process. Warm back can begin to happen at screen-out perforations while other perforations are still cooling down as more injection fluids are entering. The early warm back at Cluster 1 and Cluster 2 can be caused by a screen-out occurred. While the warm-back of Clusters 3 and Cluster 4 can occur after the hydraulic fracturing process has ended due to treatment fluid no longer being injected into the wellbore.

In block 340 of FIG. 3, the processing device 160 can determine a thermal conductivity coefficient for the perforation based on the amount of fluid having passed through the perforation. Thermal conductivity of a reservoir can vary spatially across the reservoir space as treatment fluid is entering the reservoir from the perforation. Prior to the hydraulic fracturing process, the reservoir can be a mixture of a solid portion that includes rock and a liquid portion that includes a formation fluid (e.g., oil or gas) in a cavity. As treatment fluid enters into the reservoir through perforation clusters 140*a-d*, fractures can be created and can fill will treatment fluid. The fractures can become longer and wider based on the amount of treatment fluid that enters into the reservoir. At different perforation clusters 140*a-d*, the amount of treatment fluid that enters the reservoir is different and can create different geometries of fractures.

Reservoir thermal conductivity, shown in equation 6 below, can be calculated from effective porosity, thermal conductivity of rock and injection fluid. This equation can be simplified as follows by setting the thermal conductivity of rock constant, and accepting that porosity and fluid thermal conductivity of the well varies along the location and time.

$$(\phi k_{ef}+\{1-\phi\}k_{es}).$$

The thermal conductivity for the rock can be set based on the type of rock prevalent in the subterranean formation through which the wellbore 104 is formed. In some examples, the equation can assume that there is no cross flow along wellbore direction, which can indicate that fluid only travels along a direction perpendicular to the wellbore when entering the reservoir. At a given time during the hydraulic fracturing process, an effective porosity value at each point along wellbore direction (x) can be calculated from flow data determined by the DAS. Perforations that take larger volumes of treatment fluid can have a higher effective porosity value. For a given depth along the wellbore 104, the same effective porosity value can be used along reservoir direction (r). Proppant distribution along the wellbore can also be determined from the flow data. This information can be used to calculate a volumetric fraction of proppant in the treatment fluids. By using the conductivity of the proppant the thermal conductivity coefficient for each cluster can be simplified as follows.

$$(k_{eff})^n=(k_r)^n\varphi+(k_x)^n(1-\varphi)-1<n<1$$

In this example, n is dependent on proppant size and phi is a volumetric fraction of proppant.

In block 350, the processing device 160 can generate a fluid allocation model based on the flow data, the warm-back data, and the thermal conductivity coefficient. Determining fluid allocation with a DTS using data from a DAS can provide a more accurate fluid allocation and mapping of the hydraulic fractures in a well. Using real-time DAS results can better characterize physical properties and heat transfer behavior in a DTS thermo-hydraulic model. The flow data determined by the DAS can be used to determine a volume of treatment fluid and proppant that passed through each of the perforation clusters 140*a-d* during the hydraulic fracturing process. The thermal conductivity coefficient can be used with the warm-back data to map the size, shape and location of the fractures in which the treatment fluid and proppant is positioned.

A fluid allocation model can include information on the mass balance, momentum balance, and energy balance for fluid in the wellbore and reservoirs. The following equations can be used for modeling mass balance (1), momentum balance (2), and energy balance (3) of the wellbore 104.

$$\frac{\partial \rho_f}{\partial t} = -\frac{\partial(\rho_f v)}{\partial x} - \alpha\rho_f v_r \tag{1}$$

$$\frac{\partial}{\partial t}(\rho_f v) = -\frac{\partial p}{\partial t} - \frac{\partial(\rho_f v^2)}{\partial x} - \frac{f\rho_f v|v|}{r_{wb}} - \alpha v_r \rho v + \rho_f g_r \tag{2}$$

$$\frac{\partial}{\partial t}[(\rho_f \hat{c}_{pf} - \beta\rho)T_{wb}] + \rho_f \hat{c}_{pf} v\frac{\partial T_{wb}}{\partial x} = \beta v T_{wb}\frac{\hat{c}p}{\partial x} + \frac{4}{3}\mu\left(\frac{\partial v}{\partial x}\right)^2 - \alpha v_r \rho_f \hat{c}_{pf} T_{wb} - \left(\frac{2}{r_{wb}} - \alpha\right)h_{res}(T_{wb} - T_s) \tag{3}$$

The following equations can be used for modeling mass balance (4), momentum balance (5a and 5b), and energy balance or thermal conductivity (6) of the reservoir or subterranean formation through which the wellbore is formed.

$$\frac{\partial}{\partial t}(\rho_f \phi) + \frac{1}{r}\frac{\partial}{\partial r}(r\rho_f u) = 0 \tag{4}$$

$$u = -\frac{k}{\mu}\left(\frac{\partial p}{\partial r} + \rho g_r\right) \tag{5a}$$

$$\frac{\partial p}{\partial r} = -\frac{\mu}{k}u - \beta'\rho|u|u. \tag{5b}$$

$$\frac{\partial}{\partial t}[(\rho_f \hat{c}_{pf}\phi + (1-\phi)\rho_s \hat{c}_{ps})T_s] + \frac{1}{r}\frac{\partial}{\partial r}(ru\rho_f \hat{c}_{pf} T_s) = \frac{1}{r}\frac{\partial}{\partial r}\left[r(\phi k_{ef} + \{1-\phi\}k_{es})\frac{\partial T_s}{\partial r}\right] \tag{6}$$

Wellbore and formation equations can be used to simulate transit temperature changes as colder injection fluids enter reservoir during a hydraulic fracturing process or another type of well stimulation. After the hydraulic fracturing process, the reservoir starts to warm back and the formation equations can be written as:

$$\frac{\partial}{\partial t}[(\rho_f \hat{c}_{pf}\phi + (1-\phi)\rho_s \hat{c}_{ps})T_s] = \frac{1}{r}\frac{\partial}{\partial r}\left[r(\phi k_{ef} + \{1-\phi\}k_{es})\frac{\partial T_s}{\partial r}\right] \quad (8)$$

Figure 8:
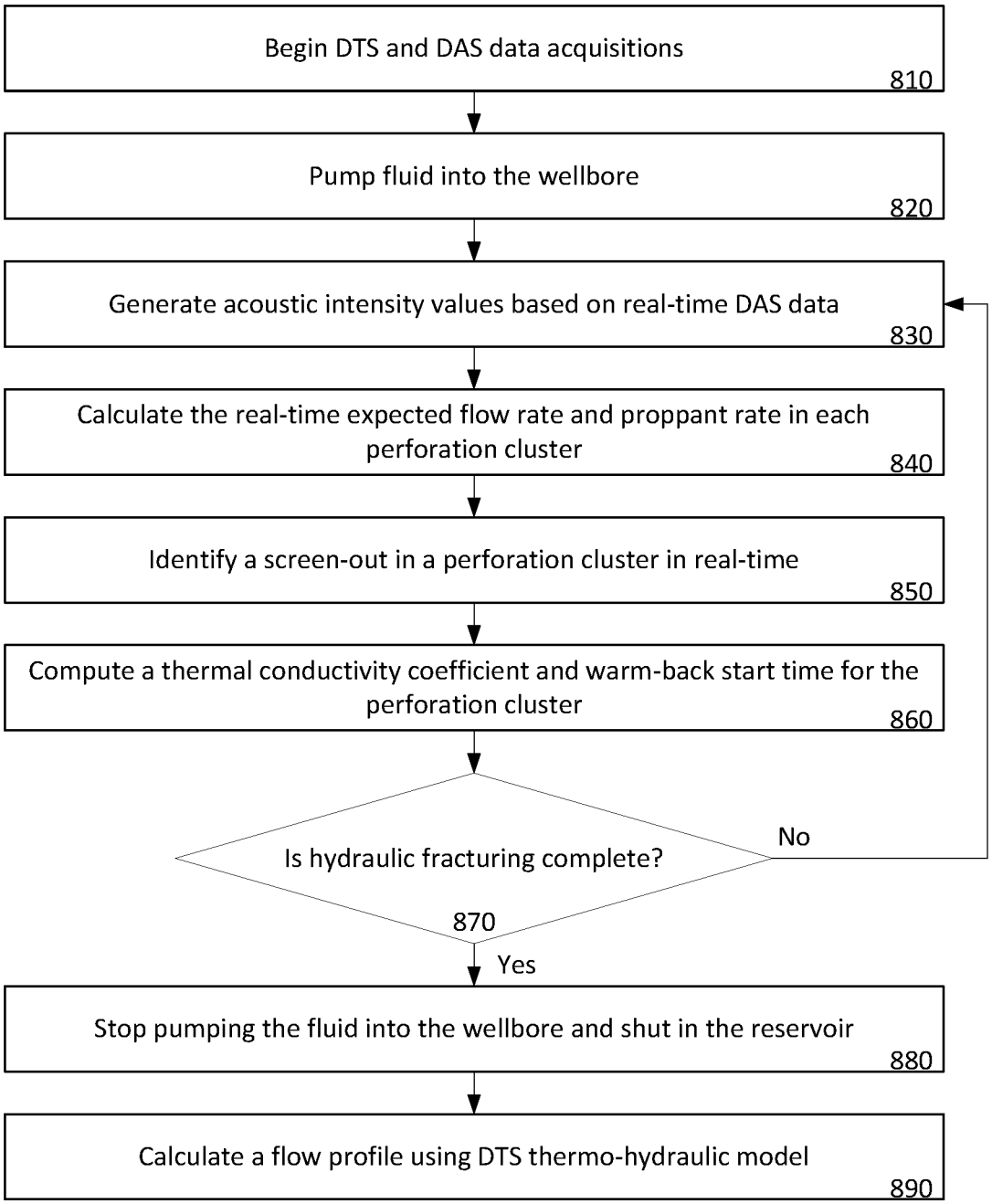
FIG. 8 is a flowchart of a hydraulic fracturing process that determines fluid allocation in a well with a distributed temperature sensing system using data from a distributed acoustic sensing system according to one aspect of the present disclosure

FIG. 8 depicts a hydraulic fracturing process that includes determining fluid allocation in a well with a DTS using data from a DAS. Data from a DAS can provide a DTS with real-time indications of screen-outs and expected flow rates, which can allow the DTS to produce a more accurate fluid allocation model. The process as described below is performed by the well system 100 in FIG. 1, but other implementations are possible.

In block 810, a DTS and a DAS begin data acquisitions. In some examples, the DTS and DAS share optical fiber 114 and interrogation subsystem 118. The processing device 160 instructs an optical source in the interrogation subsystem 118 to transmit optical signals into the optical fiber 114. Backscattered optical signals are generated by the sensors 120 based on wellbore conditions (e.g., a temperature of a perforation cluster 140*a* or an acoustic signal generated by fluid flowing through the perforation cluster 140*a*) and transmitted toward the surface 106 of the wellbore 104 in response to receiving the optical signals. An optical receiver in the interrogation subsystem 118 can receive the backscattered optical signal and communicate data based on the wellbore conditions to the processing device 160.

In block 820, the pump 130 begins pumping treatment fluid into the wellbore 104. The treatment fluid can be a mixture that includes a proppant for creating fractures in the subterranean formation through which the wellbore 104 is formed. The pump 130 can pump the treatment fluid into the wellbore 104 at an actual total flow rate that can be predetermined or varied based on signals from the processing device 160.

In block 830, the processing device 160 generates acoustic intensity values based on the real-time DAS data. In some examples, the processing device 160 generates the acoustic intensity values by observing changes in the backscattered optical signals generated based on acoustic signals in the wellbore.

In block 840, the processing device 160 calculates a real-time expected flow rate of treatment fluid and proppant passing through each perforation cluster 140*a-d*. The real-time expected flow rate can be calculated based on the acoustic intensity values. For example, the processing device 160 can calculate the real-time expected flow rate of treatment fluid passing through perforation cluster 140*a* by comparing previous acoustic intensity values associated with the perforation cluster 140*a* with a current acoustic intensity value associated with the perforation cluster 140. A difference in the magnitude of the current acoustic intensity value and previous acoustic intensity values can be used to calculate a change in the current expected flow rate for the perforation cluster 140*a* from a previous expected flow rate for the perforation cluster 140*a*. The proppant rate can be determined based on the expected flow rate of treatment fluid.

In block 850, the processing device 160 can identify a screen-out at a perforation cluster 140*a* in real-time. In some examples, the processing device 160 can identify a screen-out has occurred based on identifying an overestimate of an expected total flow rate compared to an actual total flow rate. The expected total flow rate can be determined based on combining the expected flow rate for each of the perforation clusters 140*a-d*. An overestimate of the expected total flow rate can be a substantially real-time indicator that a screen-out is occurring. In additional or alternative examples, the perforation clusters that contributed to the overestimate are identified. The processing device 160 can identify the perforation clusters that contributed to the overestimate based on a spike in expected flow rate for the perforation clusters at approximately the same time as the overestimate. The processing device 160 can determine a spike occurred by detecting a change in a slope of the expected flow rate from a positive slope to a negative slope.

The processing device 160 can identify a screen-out at a perforation cluster in real-time by comparing a positive flow rate slope of and a negative flow rate slope of the expected flow rate through the perforation cluster. The positive flow rate slope and negative flow rate slope can be determined based on more than two expected flow rate values for the identified perforation clusters. In some examples, the positive flow rate slope and the negative flow rate slope are an average of slopes of the expected flow rate prior to a time of the overestimate and an average of slopes of the expected flow rate after the overestimate. The magnitude of the negative flow rate slope can be compared to the magnitude of the positive flow rate slope. A deviation in the magnitude of the negative flow rate from the positive flow rate slope can indicate a screen-out is occurring. In some examples, the processing device 160 can determine if the magnitude of the negative flow rate slope deviates from the positive flow rate slope by comparing a difference in the slopes to a threshold value. If the difference exceeds the threshold value, the magnitude of the negative flow rate slope is determined by the processing device 160 to deviate from the magnitude of the positive flow rate slope. The threshold value can be predetermined or the threshold value can be determined based on changes in the expected flow rate at perforation clusters previously determined to have a screen-out.

In block 860, the processing device 160 computes a thermal conductivity coefficient and warm-back start time for the perforation cluster with a screen-out. The warm-back start time can be the time the screen-out occurs at the perforation cluster, which the processing device 160 can calculate based on the real-time DAS data. The processing device 160 can also calculate the thermal conductivity coefficient in response to identifying a screen-out. The volume of treatment fluid that passes through a perforation cluster can be used by the processing device 160 to determine an effective porosity value of the perforation cluster. Proppant distribution in the perforation cluster can be determined by the processing device 160 based on the expected flow rate. The thermal conductivity coefficient for the perforation cluster can be calculated using the conductivity of the proppant, the amount of proppant determined to have passed through the perforation cluster, and the porosity of the subterranean formation through which the perforation cluster is formed.

In block 870, the processing device 160 determines if the hydraulic fracturing process is complete. In some examples, the hydraulic fracturing process can be determined to be completed after a predetermined amount of time or a predetermined amount of treatment fluid has been pumped into the wellbore 104. In additional or alternative examples, the hydraulic fracturing process can be determined to be complete based on the fractures formed. The process can return to block 830 and monitor for additional screen-outs if the hydraulic fracturing process is determined to be incomplete or the process can continue to block 880 if the hydraulic process is determined to be complete.

In block 880, the pump 130 stops injecting fluid into the wellbore 104 and the reservoirs are shut in. The processing device 160 can transmit a signal to the pump 130 indicating that the hydraulic fracturing process is complete, or the pump 130 can transmit a signal to the processing device 160 indicating that the hydraulic fracturing process is complete. The processing device 160 can also instruct the DAS and DTS to cease interrogation of the sensors 120, or change data acquisition parameters to reflect shut-in conditions.

In block 890, the processing device calculates the flow profile for the well using a DTS thermo-hydraulic model. A flow profile can include information on the mass balance, momentum balance, and energy balance for fluid in the wellbore 104 and reservoirs. The processing device 160 can determine the flow profile using the thermal conductivity coefficient, warm-back start time, and warm-back data for each of the perforation clusters. For example, using the warm-back start time the processing device 160 can determine an amount of time taken by each of the perforation clusters to return to a geothermal temperature. The processing device 160 can determine that perforation clusters that take longer to return to the geothermal temperature took more treatment fluid and have a larger reservoir. By using the thermal conductivity coefficient and expected flow rates the processing device 160 can determine a size shape and location of fractures and contacted reservoir in the subterranean formation.

In some aspects, a determining fluid allocation in a well with a DTS using data from a DAS is provided according to one or more of the following examples:

Example #1

A method can include receiving, by a processing device, flow data indicating a flow rate of a fluid through a perforation in a well based on an acoustic signal generated during a hydraulic fracturing operation in the well. The method can further include receiving, by the processing device, warm-back data indicating an increase in temperature at the perforation. The method can further include generating, by the processing device, a fluid allocation model based on the flow data and the warm-back data, the fluid allocation model representing positions of the fluid in fractures formed in a subterranean formation of the well.

Example #2

The method of Example #1, can further include determining in real-time, by the processing device, that a screen-out is occurring at the perforation based on a change in the slope of the flow rate of the fluid through the perforation. The method can further include causing, by the processing device, the warm-back data to be measured at the perforation in response to determining that the screen-out is occurring at the perforation. The fluid allocation model can be used to determine a size and a location of the fractures formed during the hydraulic fracturing operation in the well.

Example #3

The method of Example #1, can further include determining, by the processing device, an amount of the fluid having passed through the perforation based on the flow data. The method can further include determining, by the processing device, a thermal conductivity coefficient for the perforation based on the amount of fluid having passed through the perforation. Generating the fluid allocation model can be further based on the thermal conductivity coefficient.

Example #4

The method of Example #3, can feature determining the thermal conductivity coefficient for the perforation further including determining a porosity of a subterranean formation through which the perforation is formed. Determining the thermal conductivity coefficient for the perforation can further include determining the thermal conductivity coefficient based on the porosity of the subterranean formation.

Example #5

The method of Example #3, can feature the fluid including a plurality of different types of fluid. Determining the amount of the fluid having passed through the perforation can include determining the amount of each type of fluid having passed through the perforation. Determining the thermal conductivity coefficient for the perforation can be further based on the types of fluid and the amount of each type of fluid having passed through the perforation.

Example #6

The method of Example #1, can feature receiving the flow data including receiving the flow data from a distributed acoustic sensing system using an optical fiber extending into the well for measuring acoustic signals or thermal signals generated in the well in real time. Receiving the warm-back data can include receiving the warm-back data from a distributed temperature sensing system using the optical fiber for measuring changes in the temperature in the well in real time.

Example #7

The method of Example #1, can feature the perforation including a plurality of perforations. Receiving the flow data can include receiving the flow data indicating a separate flow rate of the fluid through each of the perforations of the plurality of perforations. Receiving the warm-back data can include receiving the warm-back data for each of the perforations of the plurality of perforations. Generating the fluid allocation model can be based on the flow data and the warm-back data for each of the perforations of the plurality of perforations.

Example #8

A system can include a processing device and a memory. Instructions can be stored on the memory device for causing the processing device to receive flow data indicating a flow rate of a fluid through a perforation in a well based on an acoustic signal generated during a hydraulic fracturing operation in the well. The instructions can further cause the processing device to receive warm-back data indicating an increase in temperature at the perforation. The instructions can further cause the processing device to generate a fluid allocation model based on the flow data and the warm-back data. The fluid allocation model can represent positions of the fluid in fractures formed in a subterranean formation of the well.

Example #9

The system of Example #8, can include instructions for causing the processing device to determine in real time that a screen-out is occurring at the perforation based on a change in the slope of the flow rate of the fluid through the perforation. The instructions can further cause the processing device to cause the warm-back data to be measured at the perforation in response to determining that the screen-out is occurring at the perforation. The fluid allocation model can be used to determine a size and a location of the fractures formed during the hydraulic fracturing operation in the well.

Example #10

The system of Example #8, can include instructions for causing the processing device to determine an amount of the fluid having passed through the perforation based on the flow data. The instructions can further cause the processing device to determine a thermal conductivity coefficient for the perforation based on the amount of fluid having passed through the perforation. The instructions for causing the processing device to generate the fluid allocation model can include instructions for causing the processing device to generate the fluid allocation model based on the thermal conductivity coefficient.

Example #11

The system of Example #10, can feature instructions for causing the processing device to determine the thermal conductivity coefficient for the perforation further including instructions for causing the processing device to determine a porosity of a subterranean formation through which the perforation is formed. The instructions for causing the processing device to determine the thermal conductivity coefficient for the perforation can further include instructions for causing the processing device to determine the thermal conductivity coefficient based on the porosity of the subterranean formation.

Example #12

The system of Example #10, can feature the fluid including a plurality of different types of fluid. The instructions for causing the processing device to determine the amount of the fluid having passed through the perforation can include instructions for causing the processing device to determine the amount of each type of fluid having passed through the perforation. The instructions for causing the processing device to determine the thermal conductivity coefficient for the perforation can include instructions for causing the processing device to determine the thermal conductivity coefficient based on the types of fluid and the amount of each type of fluid having passed through the perforation.

Example #13

The system of Example #8, can further include a distributed acoustic sensing system and a distributed temperature sensing system. The distributed acoustic sensing system can be communicatively coupled to the processing device and can include a first optical fiber, a first optical source, and a first optical receiver. The first optical fiber can extend downhole. The first optical source can transmit a first optical signal downhole through the first optical fiber. The first optical receiver can receive a first backscattered optical signal formed based on the first optical signal responding to acoustic signals or thermal signals generated in the well in real time. The distributed temperature sensing system can be communicatively coupled to the processing device and include a second optical fiber, a second optical source, and a second optical receiver. The second optical fiber can extend downhole. The second optical source can transmit a second optical signal downhole through the second optical fiber. The second optical receiver can receive a second backscattered optical signal formed based on the second optical signal responding to the temperature in the well in real time. The instructions for causing the processing device to receive the flow data can include instructions for causing the processing device to receive the flow data based on the first backscattered optical signal from the distributed acoustic sensing system. The instructions for causing the processing device to receive the warm-back data can include instructions for causing the processing device to receive the warm-back data based on the second backscattered optical signals from the distributed temperature sensing system.

Example #14

The system of Example #8, can feature the perforation including a plurality of perforations. The instructions for causing the processing device to receive the flow data can include instructions for causing the processing device to receive the flow data indicating a separate flow rate of the fluid through each of the perforations of the plurality of perforations. The instructions for causing the processing device to receive the warm-back data can include instructions for causing the processing device to receive the warm-back data for each of the perforations of the plurality of perforations. The instructions for causing the processing device to generate the fluid allocation model can include instructions for causing the processing device to generate the fluid allocation model based on the flow data and the warm-back data for each of the perforation of the plurality of perforations.

Example #15

A non-transitory computer-readable medium in which instructions that can be executed by a processing device are stored. The instructions can be executed by the processing device for causing the processing device to receive flow data indicating a screen-out is occurring at a perforation in a well based on an acoustic signal generated in the well during a hydraulic fracturing operation. The instructions can be executed by the processing device for causing the processing device to receive warm-back data indicating an increase in temperature at the perforation in response to the screen-out. The instructions can be executed by the processing device for causing the processing device to generate a fluid allocation model based on the warm-back data, the fluid allocation model representing calculations of positions of the fluid in fractures formed in a subterranean formation of the well.

Example #16

The non-transitory computer-readable medium of Example #15, can feature the instructions that can be executed by the processing device for causing the processing device to receive the flow data indicating the screen-out is occurring including instructions for causing the processing device to receive the flow data indicating flow rate of the fluid through the perforation. The instructions can further cause the processing device to determine in real time that the screen-out is occurring at the perforation based on a change in a slope of the flow rate of the fluid through the perforation. The fluid allocation model can be used to determine a size and location of the fractures formed during the hydraulic fracturing process in the well.

Example #17

The non-transitory computer-readable medium of Example #15, can include instructions for causing the processing device to determine an amount of the fluid having passed through the perforation based on the flow data. The instructions can further cause the processing device to determine a thermal conductivity coefficient for the perforation based on the amount of fluid having passed through the perforation. The instructions executed by the processing device for causing the processing device to generate the fluid allocation model can include causing the processing device to generate the fluid allocation model based on the thermal conductivity coefficient.

Example #18

The non-transitory computer-readable medium of Example #17, can feature instructions that can be executed by the processing device for causing the processing device to determine the thermal conductivity coefficient for the perforation further including instructions that can be executed by the processing device for causing the processing device to determine a porosity of a subterranean formation through which the perforation is formed and determine the thermal conductivity coefficient based on the porosity of the subterranean formation.

Example #19

The non-transitory computer-readable medium of Example #17, can feature the fluid including a plurality of different types of fluid. The instructions can be executed by the processing device for causing the processing device to determine the amount of the fluid having passed through the perforation including instructions that can be executed by the processing device for causing the processing device to determine the amount of each type of fluid having passed through the perforation. The instructions can be executed by the processing device for causing the processing device to determine the thermal conductivity coefficient for the perforation including instructions that can be executed by the processing device for causing the processing device to determine the thermal conductivity coefficient based on the types of fluid and the amount of each type of fluid having passed through the perforation.

Example #20

The non-transitory computer-readable medium of Example #15, can feature the instructions that can be executed by the processing device for causing the processing device to receive the flow data including instructions that can be executed by the processing device for causing the processing device to receive the flow data from a distributed acoustic sensing system using an optical fiber extending into the well for measuring acoustic signals generated in the well in real time. The instructions that can be executed by the processing device for causing the processing device to receive the warm-back data including instructions that can be executed by the processing device for causing the processing device to receive the warm-back data from a distributed temperature sensing system using the optical fiber for measuring changes in the temperature in the well in real time.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A method comprising:

receiving, by a processing device, flow data indicating a flow rate of a fluid through a perforation in a well based on an acoustic signal generated during a hydraulic fracturing operation in the well;

receiving, by the processing device, warm-back data indicating an increase in temperature at the perforation;

determining, by the processing device, an amount of the fluid having passed through the perforation based on the flow data;

determining, by the processing device, a thermal conductivity coefficient for the perforation based on the amount of the fluid having passed through the perforation; and generating, by the processing device, a fluid allocation model based on the flow data, the thermal conductivity coefficient, and the warm-back data, the fluid allocation model representing positions of the fluid in fractures formed in a subterranean formation of the well.

2. The method of claim 1, further comprising:

generating, by the processing device, a plot of expected flow rate of fluid through the perforation over a period of time;

determining in real-time, by the processing device, that a screen-out is occurring at the perforation based on a change in a slope of the plot of expected flow rate of the fluid through the perforation; and causing, by the processing device, the warm-back data to be measured at the perforation in response to determining that the screen-out is occurring at the perforation, wherein the fluid allocation model is usable to determine a size and a location of the fractures formed during the hydraulic fracturing operation in the well.

3. The method of claim 1, wherein determining the thermal conductivity coefficient for the perforation further comprises:

determining a porosity of a subterranean formation through which the perforation is formed; and determining the thermal conductivity coefficient based on the porosity of the subterranean formation.

4. The method of claim 1, wherein the fluid comprises a plurality of different types of fluid, wherein determining the amount of the fluid having passed through the perforation comprises determining an amount of each type of fluid having passed through the perforation, wherein determining the thermal conductivity coefficient for the perforation is further based on the types of fluid and the amount of each type of fluid having passed through the perforation.

5. The method of claim 1, wherein receiving the flow data comprises receiving the flow data from a distributed acoustic sensing system using an optical fiber extending into the well for measuring acoustic signals or thermal signals generated in the well in real time, wherein receiving the warm-back data comprises receiving the warm-back data from a distributed temperature sensing system using the optical fiber for measuring changes in the temperature in the well in real time.

6. The method of claim 1, wherein the perforation comprises a plurality of perforations, wherein receiving the flow data comprises receiving the flow data indicating a separate flow rate of the fluid through each of the perforations of the plurality of perforations, wherein receiving the warm-back data comprises receiving the warm-back data for each of the perforations of the plurality of perforations, wherein generating the fluid allocation model is based on the flow data and the warm-back data for each of the perforations of the plurality of perforations.

7. A system comprising:

a processing device; and a memory device on which instructions are stored for causing the processing device to:

receive flow data indicating a flow rate of a fluid through a perforation in a well based on an acoustic signal generated during a hydraulic fracturing operation in the well;

receive warm-back data indicating an increase in temperature at the perforation;

determine an amount of the fluid having passed through the perforation based on the flow data;

determine a thermal conductivity coefficient for the perforation based on the amount of the fluid having passed through the perforation; and generate a fluid allocation model based on the flow data, the thermal conductivity coefficient, and the warm-back data, the fluid allocation model representing positions of the fluid in fractures formed in a subterranean formation of the well.

8. The system of claim 7, wherein the instructions are further for causing the processing device to:

generate a plot of expected flow rate of fluid through the perforation over a period of time;

determine in real time that a screen-out is occurring at the perforation based on a change in a slope of the plot of expected flow rate of the fluid through the perforation; and cause the warm-back data to be measured at the perforation in response to determining that the screen-out is occurring at the perforation, wherein the fluid allocation model is usable to determine a size and a location of the fractures formed during the hydraulic fracturing operation in the well.

9. The system of claim 7, wherein the instructions for causing the processing device to determine the thermal conductivity coefficient for the perforation further comprises instructions for causing the processing device to:

determine a porosity of a subterranean formation through which the perforation is formed; and determine the thermal conductivity coefficient based on the porosity of the subterranean formation.

10. The system of claim 7, wherein the fluid comprises a plurality of different types of fluid, wherein the instructions for causing the processing device to determine the amount of the fluid having passed through the perforation comprises instructions for causing the processing device to determine an amount of each type of fluid having passed through the perforation, wherein the instructions for causing the processing device to determine the thermal conductivity coefficient for the perforation comprises instructions for causing the processing device to determine the thermal conductivity coefficient based on the types of fluid and the amount of each type of fluid having passed through the perforation.

11. The system of claim 7, further comprising:

a distributed acoustic sensing system communicatively coupled to the processing device, the distributed acoustic sensing system comprising:

a first optical fiber extendable downhole;

a first optical source for transmitting a first optical signal downhole through the first optical fiber; and a first optical receiver for receiving a first backscattered optical signal formed based on the first optical signal responding to acoustic signals or thermal signals generated in the well in real time; and a distributed temperature sensing system communicatively coupled to the processing device, the distributed temperature sensing system comprising:

a second optical fiber extendable downhole;

a second optical source for transmitting a second optical signal downhole through the second optical fiber; and a second optical receiver for receiving a second backscattered optical signal formed based on the second optical signal responding to the temperature in the well in real time, wherein the instructions for causing the processing device to receive the flow data comprise instructions for causing the processing device to receive the flow data based on the first backscattered optical signal from the distributed acoustic sensing system, wherein the instructions for causing the processing device to receive the warm-back data comprise instructions for causing the processing device to receive the warm-back data based on the second backscattered optical signals from the distributed temperature sensing system.

12. The system of claim 7, wherein the perforation comprises a plurality of perforations, wherein the instructions for causing the processing device to receive the flow data comprises instructions for causing the processing device to receive the flow data indicating a separate flow rate of the fluid through each of the perforations of the plurality of perforations, wherein the instructions for causing the processing device to receive the warm-back data comprise instructions for causing the processing device to receive the warm-back data for each of the perforations of the plurality of perforations, wherein the instructions for causing the processing device to generate the fluid allocation model comprises instructions for causing the processing device to generate the fluid allocation model based on the flow data and the warm-back data for each of the perforation of the plurality of perforations.

13. A non-transitory computer-readable medium in which instructions executable by a processing device are stored for causing the processing device to:

receive flow data indicating a screen-out is occurring at a perforation in a well based on an acoustic signal generated in the well during a hydraulic fracturing operation;

receive warm-back data indicating an increase in temperature at the perforation in response to the screen-out;

determine an amount of a fluid having passed through the perforation based on the flow data;

determine a thermal conductivity coefficient for the perforation based on the amount of the fluid having passed through the perforation; and generate a fluid allocation model based on the warm-back data and the thermal conductivity coefficient, the fluid allocation model representing calculations of positions of the fluid in fractures formed in a subterranean formation of the well.

14. The non-transitory computer-readable medium of claim 13, wherein the instructions executable by the processing device for causing the processing device to receive the flow data indicating the screen-out is occurring comprises instructions executable by the processing device for causing the processing device to:

receive the flow data indicating a flow rate of the fluid through the perforation;

generate a plot of expected flow rate of fluid through the perforation over a period of time;

determine in real time that the screen-out is occurring at the perforation based on a change in a slope of the plot of expected flow rate of the fluid through the perforation, wherein the fluid allocation model is usable to determine a size and location of the fractures formed during the hydraulic fracturing process in the well; and wherein the instructions executable by the processing device for causing the processing device to determine the thermal conductivity coefficient for the perforation further comprises instructions executable by the processing device for causing the processing device to determine a porosity of a subterranean formation through which the perforation is formed and determine the thermal conductivity coefficient based on the porosity of the subterranean formation.

15. The non-transitory computer-readable medium of claim 13, wherein the fluid comprises a plurality of different types of fluid, wherein the instructions executable by the processing device for causing the processing device to determine the amount of the fluid having passed through the perforation comprises instructions executable by the processing device for causing the processing device to determine an amount of each type of fluid having passed through the perforation, wherein the instructions executable by the processing device for causing the processing device to determine the thermal conductivity coefficient for the perforation comprises instructions executable by the processing device for causing the processing device to determine the thermal conductivity coefficient based on the types of fluid and the amount of each type of fluid having passed through the perforation.

16. The non-transitory computer-readable medium of claim 13, wherein the instructions executable by the processing device for causing the processing device to receive the flow data comprises instructions executable by the processing device for causing the processing device to receive the flow data from a distributed acoustic sensing system using an optical fiber extendable into the well for measuring acoustic signals generated in the well in real time, wherein the instructions executable by the processing device for causing the processing device to receive the warm-back data comprises instructions executable by the processing device for causing the processing device to receive the warm-back data from a distributed temperature sensing system using the optical fiber for measuring changes in the temperature in the well in real time.

* * * * *